US005634804A

United States Patent [19]

Steinhauser et al.

[11] Patent Number: 5,634,804

[45] Date of Patent: Jun. 3, 1997

[54] DETACHABLE PLUG CONNECTION

[75] Inventors: Uwe Steinhauser, Filderstadt; Stefan Fenger, Waiblingen, both of Germany

[73] Assignee: Robert Bosch GmbH, Stuttgart, Germany

[21] Appl. No.: 470,556

[22] Filed: Jun. 6, 1995

[30] Foreign Application Priority Data

Jun. 21, 1994 [DE] Germany ..... 9410052 U

[51] Int. Cl.[6] ..... H01R 13/62

[52] U.S. Cl. ..... 439/157

[58] Field of Search ..... 439/153, 157, 439/160, 372

[56] References Cited

FOREIGN PATENT DOCUMENTS 3407725 9/1985 Germany .

*Primary Examiner*—David L. Pirlot

*Assistant Examiner*—Brian J. Biggi

*Attorney, Agent, or Firm*—Kenyon & Kenyon

[57] ABSTRACT

The locking lever of a detachable electrical plug connection can be produced cost-effectively and makes it possible to lock the plug connection securely. The locking lever is manufactured completely from a sheet-metal part, first guide elements, by means of which the locking lever is mounted on a plug housing such that it can rotate, being produced on the one hand, and second guide elements, by means of which the locking lever engages in guide tracks of a plug receptacle, being produced, for example via a deep-drawing or thermoforming process on the other hand. For functionally secure guidance of the locking lever, the first guide elements preferably have stamped projections as an axial withdrawal protection device, which secure the position of the locking lever even when forces are applied in this position which are directed transversely with respect to the pivoting direction. The locking lever is preferably used in the case of multipole elongated electrical plug connections.

4 Claims, 1 Drawing Sheet

DETACHABLE PLUG CONNECTION

FIELD OF THE INVENTION

The present invention relates to a detachable plug connection.

BACKGROUND INFORMATION

German Patent Application No. DE 34 07 725 A1 describes that a detachable electrical plug connection, for the insertion and withdrawal forces of the plug, in relation to the plug receptacle, to be applied by means of a locking lever mounted on the plug, can pivot and is supported during pivoting on guide tracks of the plug receptacle.

The locking lever is an essentially U-shaped bracket whose limbs are connected in the form of elbows. A bolt is mounted close to the free end of each limb, which bolt projects on the inside of the limb and is articulated into a hole in the plug housing such that it can pivot. A guide bolt which engages in a guide track of the plug receptacle is mounted in the elbow region of each limb, on its outside, the guide bolt and the associated guide track being formed so as to run conically in opposite directions.

During the production of such a locking lever, the lever base body, as the sheet-metal bet part, on the one hand and the bolts and/or guide bolts, as rotating parts, on the other hand, are produced separately. Each of the bolts and the guide bolts is fitted on the ends associated with the limbs with one retaining pin, which is inserted into corresponding holes in the limbs and is then fixed by welding.

As a result of the manufacturing, which runs counter to economical production, the fabrication of these locking levers is cost-intensive in a disadvantageous manner.

SUMMARY OF THE INVENTION

The detachable plug connection according to the present invention has the advantage that the previously mentioned shortcoming is avoided to a satisfactory extent. To this end, the locking lever is manufactured integrally with all its components. This refinement of the locking lever, which is secured in position by stamped projections on guide elements as an axial withdrawal protection device, makes it possible to manufacture the locking lever cost-effectively and in a manner which can be automated.

DETAILED DESCRIPTION

Figure 1:
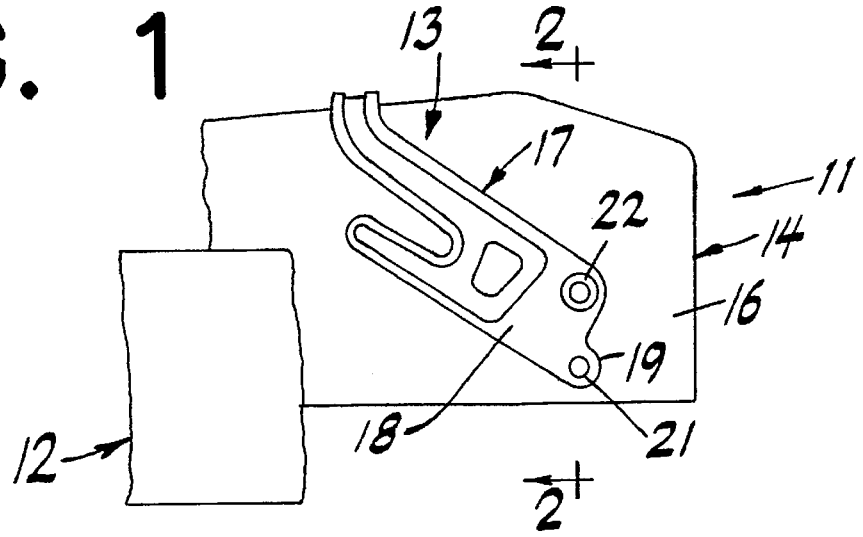
FIG. 1 shows a side view of a locking lever which is mounted on a plug housing, according to the present invention.
Figure 2:
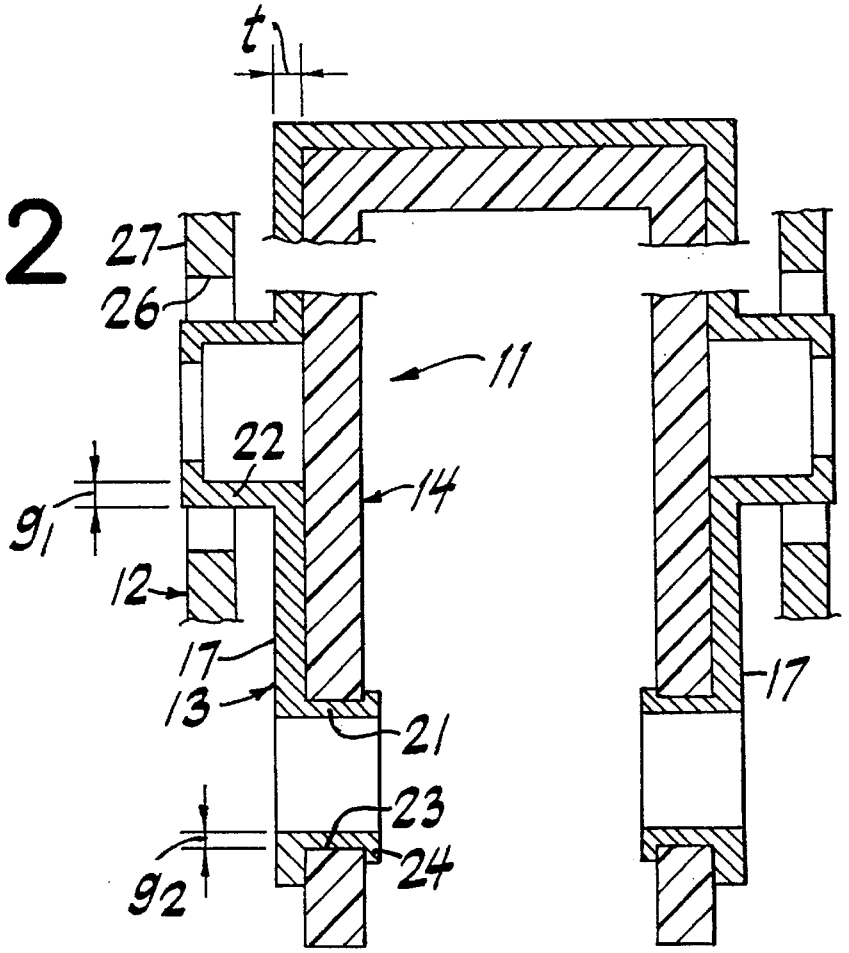
FIG. 2 shows a cross-sectional view along the line A—A in FIG. 1.

Referring to FIGS. 1 and 2, an electrical coupling device which is designed as a multipole, elongated electrical plug connection has as the main components a plug 11, a plug receptacle 12, and a locking lever 13 as part of a mounting device for the plug 11 on the plug receptacle 12.

A box-shaped plug housing 14 which is made of plastic and has longitudinal walls 16 running parallel to one another is constructed on the plug 11 in a manner which is generally known from German Patent Application No. DE 34 07 725 A1 and is not illustrated in more detail. A projecting mounting hook is integrally formed on one narrow side of the plug housing 14, which mounting hook hooks, when the plug 11 and the plug receptacle 12 are being joined together, into a retaining part, which is likewise in the form of a hook and is formed such that it runs counter to the mounting hook, of the plug receptacle 12 to form a hinged joint about which the plug 11 is pivoted towards the plug receptacle 12.

The plug connection is closed with the aid of the locking lever 13. The locking lever 13, which is designed as a double-limbed, U-shaped, sheet-metal bent part, has two side limbs 17 for this purpose, which side limbs 17 are connected on one side by means of a transverse web. The side limbs 17, which are opposite in a manner such that they run parallel and are congruent, each have an elongated center part 18 originating from the transverse web. A semicircular tab 19 is adjacent thereto, as an exposed end region. A first guide element 21 is arranged in the tab 19, and a second guide element 22 is arranged at the end of the center part 18, towards the tab 19. The guide elements 21, 22 each have the form of a bearing bolt in the form of a sleeve.

The first guide element 21 projects on the inside of the side limbs 17 and extends, such that it can pivot, through an associated hole 23 in the longitudinal wall 16 of the plug housing 14. A stamped projection 24, which is in the form of an annular collar and whose external diameter is greater than the diameter of the hole 23, is applied to the exposed end, which extends out of the hole 23, of the first guide element 21, after the installation of tho first guide element 21 in the longitudinal wall 16.

The second guide element 22 projects on the outside of the side limb 17 and can be inserted into a guide track 26 in a side wall 27 of the plug receptacle 12. Each of the two guide elements 21, 22 can be constructed such that the wall thicknesses of the guide elements (g1, g2) are substantially (approximately) the same as the thickness (t) of the side limbs 17.

During a pivoting movement of the locking lever 13 about the first guide elements 21 in order to close the plug connection, the second guide elements 22 are supported in the guide tracks 26 and at the same time draw the plug 11 into the plug receptacle 12. Forces which occur in this process and run transversely with respect to the pivoting direction are avoided by the stamped projection 24 or by the side limbs 17 running onto the longitudinal walls 16, 80 that the position of the second guide element 22 in the guide track 26 is secured.

In this way, a locking lever 13 for a detachable plug connection is implemented which can be manufactured cost-effectively, especially as a deep-drawn or thermoformed part, as a result of its integral form and which, as a result of the refinement, preferably of the first guide elements 21, is guided in a functionally secure manner.

What is claimed is:

1. A detachable plug connection comprising:

a plug;

a locking lever;

a first guide element mounting the locking lever on the plug such that the locking lever is pivotable within a pivoting plane, the first guide element being integral with the locking lever;

a second guide element integral with the locking lever; and a plug receptacle having at least one guide track for receiving the second guide element and locking the locking lever;

wherein at least one of the first and second guide elements has a stamped projection located in the pivoting plane, the stamped projection providing axial withdrawal protection for the locking lever.

2. The detachable plug connection according to claim 1, wherein each of the first and second guide elements has a first wall thickness approximately the same as a second wall thickness of a remainder of the locking lever.

3. The detachable plug connection according to claim 1, wherein the locking lever is U-shaped having at least two side limbs located in the pivoting plane, each of the side limbs having a first end and a second end opposite the first end, the first end being connected to the first guide element, the second end being connected to the second guide element.

4. The detachable plug connection according to claim 1, wherein each of the first and second guide elements is sleeve-shaped.

* * * * *